US009259093B2

(12) United States Patent
Leng

(10) Patent No.: US 9,259,093 B2
(45) Date of Patent: Feb. 16, 2016

(54) FOLDING SOFA BED

(71) Applicant: NEW-TEC INTEGRATION (XIAMEN) CO., LTD., Xiamen, Fujian (CN)

(72) Inventor: Luhao Leng, Xiamen (CN)

(73) Assignee: NEW-TEC INTEGRATION (XIAMEN) CO., LTD., Xiamen (CN)

( * ) Notice: Subject to any disclaimer, the term of this patent is extended or adjusted under 35 U.S.C. 154(b) by 0 days.

(21) Appl. No.: 14/596,245

(22) Filed: Jan. 14, 2015

(65) Prior Publication Data

US 2015/0196128 A1 Jul. 16, 2015

(30) Foreign Application Priority Data

Jan. 15, 2014 (CN) ..... 2014 1 0017417

(51) Int. Cl.
*A47C 17/17* (2006.01)
*A47C 17/175* (2006.01)

(52) U.S. Cl.
CPC ..... *A47C 17/1756* (2013.01); *A47C 17/1753* (2013.01)

(58) Field of Classification Search
CPC ..... A47C 17/17
USPC ..... 5/37.1, 38, 41, 47–48
See application file for complete search history.

(56) References Cited

U.S. PATENT DOCUMENTS 5,315,722 A * 5/1994 Djie ..... 5/37.1
6,349,431 B1 * 2/2002 Meade et al. ..... 5/37.1
6,357,062 B1 * 3/2002 Woll et al. ..... 5/37.1

* cited by examiner

*Primary Examiner* — Fredrick Conley
(74) *Attorney, Agent, or Firm* — Rabin & Berdo, P.C.

(57) ABSTRACT

A folding sofa bed comprises a bed frame, a seat mattress and a seat back. The bed frame comprises two armrest borders and a front horizontal bar and a rear horizontal bar connecting the two armrest borders. A central portion of the armrest border is disposed with a long sliding groove of backwardly disposed and downwardly inclined sliding groove, two hinges and two connecting bars. Each of the hinges comprises a front hinge plate and a rear hinge plate, the front hinge plate is connected to the seat mattress, the rear hinge plate is connected to the seat back, the front hinge plate is disposed with a guide bar, the guide bar is slidably disposed inside the sliding groove, the two ends of the connecting bar are respectively hinged to the armrest border and the seat back.

15 Claims, 5 Drawing Sheets

FOLDING SOFA BED

FIELD OF THE INVENTION

The present invention relates to a folding sofa bed.

BACKGROUND OF THE INVENTION

A sofa is composed of a seat mattress and a seat back. To provide the sofa with more functions, there are sofas with the seat mattress and the seat back connecting together by a hinge mechanism, when the seat mattress and the seat back intersect with an angle, the sofa functions as a seat sofa for people to seat and to rest; when the seat back and the seat mattress are unfolded using the hinge mechanism, the sofa functions as a bed for people to sleep.

However, the hinge mechanism to connect the seat back and the seat mattress in some cases is a complex structure with high manufacture cost and inconvenient assembly, in other cases, at least two persons are needed at the same time to operate from two sides of the sofa to rotate the seat back, thus making the sofa bed difficult to operate.

SUMMARY OF THE INVENTION

The present invention is provided with a folding sofa bed, which overcomes the disadvantages of the existing technology. The technical proposal of the present invention to solve the technical problem is that:

A folding sofa bed, comprising:

a bed frame comprising: two armrest borders and a front horizontal bar and a rear horizontal bar connecting the two armrest borders, a central portion of the armrest border disposed with a backwardly disposed and downwardly inclined sliding groove having an upper end and a lower end, two hinges and two connecting bars, each of the hinges comprising a front hinge plate and a rear hinge plate, the front hinge plate connected to the seat mattress, the rear hinge plate connected to the seat back, the front hinge plate disposed with a guide bar, the guide bar slidably disposed inside the sliding groove, the two ends of the connecting bar being respectively hinged to the armrest border and the seat back, the connecting bar supporting the seat back forwardly and inclined upwardly, a seat mattress and a seat back attached to the bed frame, the seat back and the seat mattress changeable between an unfolded bed position and a folded sofa position; wherein:

in the unfolded bed position, the guiding bar is situated at the upper end of the sliding groove, the seat mattress is horizontally supported by the front horizontal bar, the seat back is horizontally supported by the rear horizontal bar; and in the folded seat position, the guiding bar drops to the lower end of the sliding groove, the seat mattress is inclined and supported by the front horizontal bar, the seat back is inclined and supported by the connecting bars.

a bottom portion of the seat mattress is disposed with a lock block, the lock block abuts against the front horizontal bar when in the unfolded bed position.

In another preferred embodiment, a lock mechanism to lock the guiding bar is disposed at the lower end position of the sliding groove.

In another preferred embodiment, each of the armrest borders comprises a front leg, a rear leg and a guiding rail connecting the front leg and the rear leg, the sliding groove is disposed in the guiding rail.

In another preferred embodiment, the guiding rail comprises an inclined section, an upper straight section connected to a front end of the inclined section and a lower straight section connected to a rear end of the inclined section, the sliding groove is disposed in the inclined section, an end portion of the connecting bar is hinged to the lower straight section.

In another preferred embodiment, the armrest border further comprises an armrest bar, the armrest bar connecting the top end of the front leg and the top end of the rear leg.

In another preferred embodiment, the armrest border comprises a front leg, a rear leg and a guiding rail connecting the front leg and the rear leg, the guiding rail comprising an inclined section, an upper straight section connected to a front end of the inclined section and a lower straight section connected to a rear end of the inclined section, the sliding groove is disposed in the inclined section;

wherein one end of the connecting bar is hinged to the end portion of the lower straight section, the other end is hinged to the seat back; wherein the front hinge plate is connected to the seat mattress, the rear hinge plate is connected to the edge of the seat back; wherein the front hinge plate is disposed with the guiding rail, the guiding rail is slidably connected in the sliding groove; and wherein the connecting bar, the seat back, the seat mattress, the hinge and the guiding rail form a linkage mechanism.

In another preferred embodiment, the upper end of the sliding groove is disposed with a position portion.

In another preferred embodiment, a cross-section of the sliding groove, and the front end of the corresponding guiding rail are T shaped.

Compared to the existing technology, the technical proposal of the present invention has some of the below advantages:

1. The guiding bar is slidably disposed inside the sliding groove. The seat mattress is supported on the front horizontal bar. The connecting bars support the seat back forwardly and inclined upwardly. The seat back is supported on the rear horizontal bar. The structure is simple and is convenient to assemble. To change from the unfolded bed position to the folded sofa position, one pulls the seat back backwardly and lifts it upwardly, the guiding bar slides to the bottom of the sliding groove, thus forming an angle needed for the sofa position. To change from the folded sofa position to the unfolded bed position, one lifts the seat mattress upwardly and pulls it forward by hand, through the combination of the pulling force and the gravity of the seat back, the guiding bar slides upwardly to the top end of the sliding groove, so that the seat back and the seat mattress form a 180° angle in the unfolded bed position. Therefore, a person can quickly and sassily change the folding sofa bed of the present invention from the unfolded position to the sofa folded position, it is convenient to operate. For household use, it reduces the cost and saves the occupying space, resulting in commercial value.
2. The bottom of the seat mattress is disposed with a lock block, when in the unfolded bed position, the lock block abuts against the front horizontal bar, thus reducing the pressure to the guiding rail, making the folding sofa bed more stable in the unfolded bed position.

3. The armrest border is disposed with a lock mechanism to lock the guiding bar at the lower end position of the sliding groove, it also enhances the stability of the folding sofa bed in the unfolded bed position.

BRIEF DESCRIPTION OF THE DRAWINGS

The present invention will be further described with the drawings and the embodiments.

DETAILED DESCRIPTION OF THE EMBODIMENTS

Figure 1:
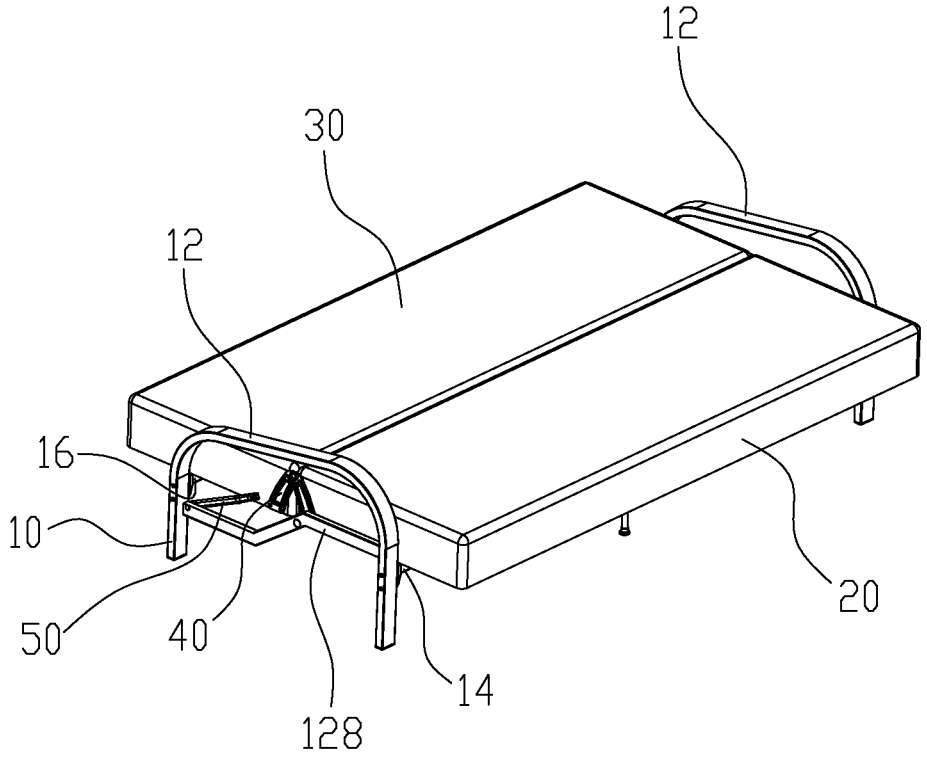
FIG. 1 illustrates a schematic diagram of a folding sofa bed in an unfolded bed position.

Please refer to FIG. 1 to FIG. 4, a folding sofa bed of the present invention comprises a bed frame 10, a seat mattress 20 and a seat back 30 attached to the bed frame 10, two hinges 40 and two connecting bar 50. The seat back 30 and the seat mattress 20 are changeable between an unfolded bed position (as figured in FIG. 1 and FIG. 2) and a folded sofa position (as figured in FIG. 3 and FIG. 4).

The bed frame 10 comprises two armrest borders 12, a front horizontal bar 14 and a rear horizontal bar 16 connecting the two armrest borders 12. Each armrest border 12 comprises an armrest bar 122, a front leg 124, a rear leg 126, and a guiding rail 128. The armrest bar 122 connects the top end of the front leg 124 and the top end of the rear leg 126. The armrest bar 122, the front leg 124 and the rear leg 126 may be formed to be n-shaped from a bended steel pipe. The front horizontal bar 14 connects the front legs 124 of the two armrest borders 12. The rear horizontal bar 16 connects the rear legs 126 of the two armrest borders 12. The guiding rail 128 comprises an inclined section 1282, an upper straight section 1284 connected to the front end of the inclined section 1282, and a lower straight section 1286 connected to the rear end of the inclined section 1282, the front end of the inclined section 1282 is higher than the rear end. The distal end of the upper straight section 1284 is connected to the front leg 124, the external end of the lower straight section 1286 is connected to the rear leg 126. The inner surface of the inclined section 1282 is concaved with a long sliding groove 121 of backwardly and downwardly inclined along the longitudinal direction, the sliding groove 121 is T-shaped (as figured in FIG. 5). The upper end of the sliding groove 121 is disposed with a position portion 1212 (as figured in FIG. 4).

The bottom of the seat mattress 20 is disposed with a lock block 22, the lock block 22 corresponds to the front horizontal bar 14.

Two hinges 40 respectively corresponding to the two armrest borders 12 are disposed at the two sides of the seat mattress 20 and the seat back 30. The hinges 40 are used to make the seat mattress 20 rotate with respect to the seat back 30. Each hinge 40 comprises a front hinge plate 42 and a rear hinge plate 44, the front hinge plate 42 is hinged to the rear hinge plate 44. The front hinge plate 42 is connected to the seat mattress 20, the rear hinge plate is connected to the seat back 30. The front hinge plate 42 is disposed with a guiding bar 422, the guiding bar 422 is T-shaped (as figured in FIG. 5). The guiding bar 422 is slidably disposed inside the sliding groove 121.

Two connecting bars 50 respectively corresponding to the two armrest borders 12 are disposed at the two sides of the seat mattress 20 and the seat back 30. One end of the connecting bar 50 is hinged to the lower straight section 1286, the other end of the connecting bar 50 is hinged to the side of the seat back 30. The seat back 30 is supported by the connecting bars 50 forwardly and inclined upwardly.

Figure 2:
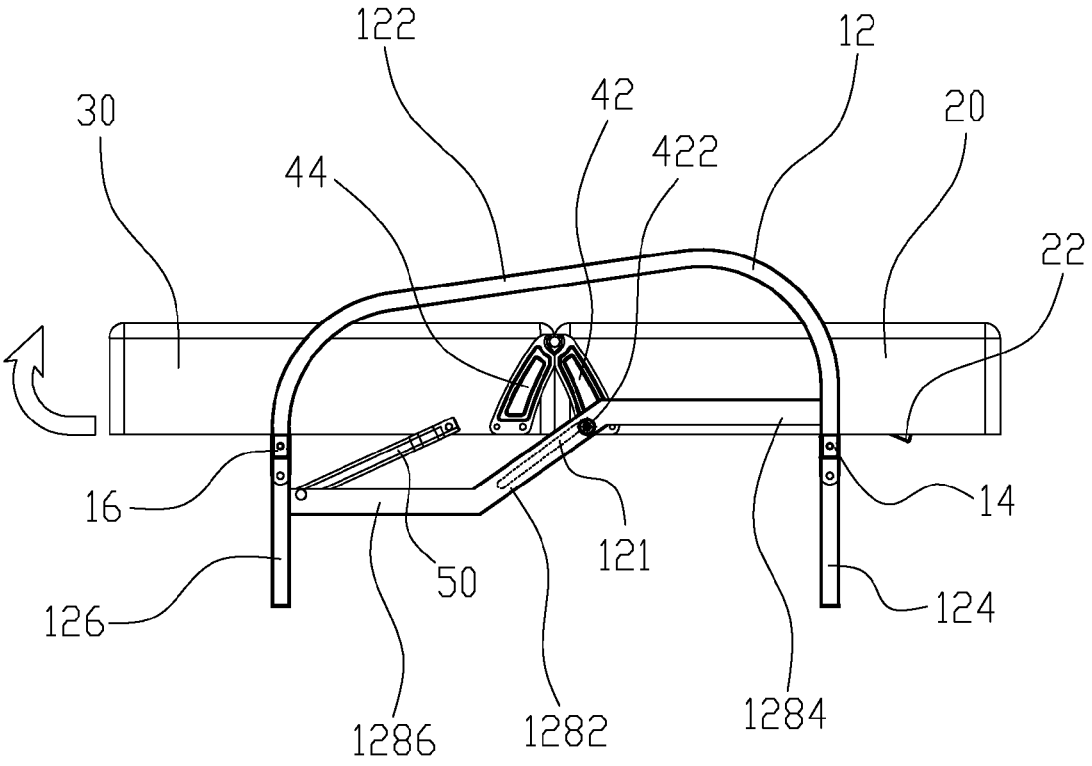
FIG. 2 illustrates a side diagram of the folding sofa bed in an unfolded bed position.

Please refer to FIG. 1 and FIG. 2, when in an unfolded bed position, the guiding bar 422 is situated at the position portion 1212 of the upper end of the sliding groove 121, the seat mattress 20 is supported on the front horizontal bar 14 horizontally; the seat back 30 is supported on the rear horizontal bar 16 horizontally, the connecting bars 50 support on the seat back 30 forwardly and inclined upwardly.

The connecting bar 50, the seat back 30, the seat mattress 20, the hinge 50 and the guiding rail 422 form a linkage mechanism, so that the present invention is convenient to change between the folded bed position and the unfolded sofa position.

Figure 3:
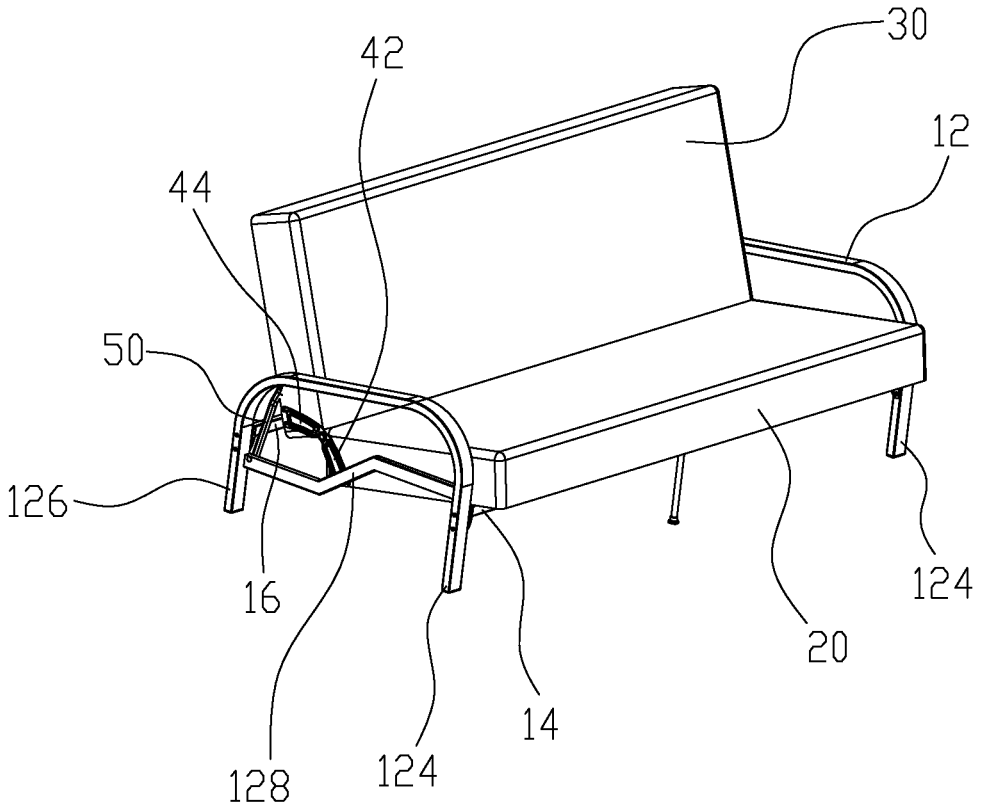
FIG. 3 illustrates a schematic diagram of the folding sofa bed in a folded sofa position.
Figure 4:
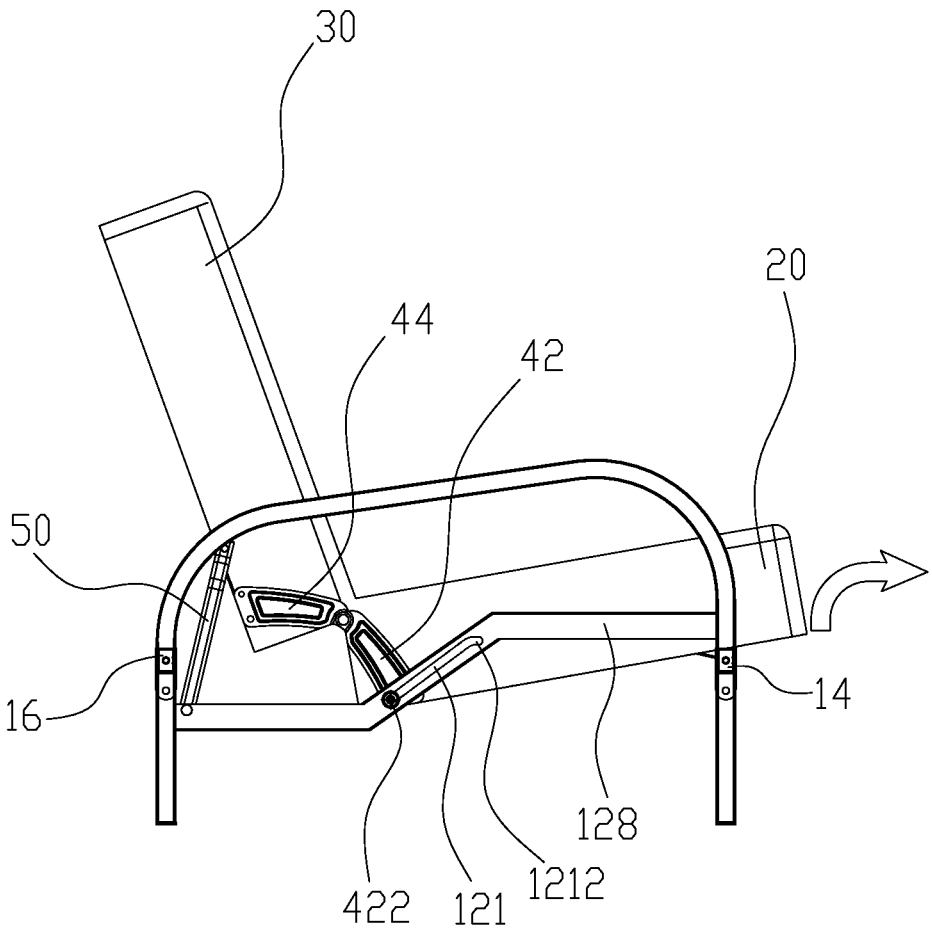
FIG. 4 illustrates a side schematic diagram of the folding sofa bed in a folded sofa position.
Figure 5:
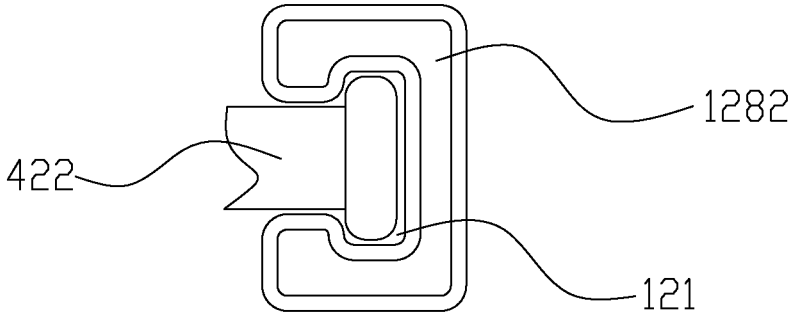
FIG. 5 illustrates a sectional schematic diagram of a guiding bar and a sliding groove of the folding sofa bed.

As illustrated collectively in FIG. 3 and FIG. 4, to change the unfolded bed position to the sofa folded position, pulling the seat back 30 backwardly and lifting it upwardly, the guiding bar 422 slides to the lower end of the sliding groove 121, the seat mattress 20 is inclined and supported on the front horizontal bar 14, the lock block 22 abuts against the front horizontal bar 14; the seat back 30 is inclined and supported by the connecting bar 50.

To transition from the folded sofa position to the unfolded bed position, lifting the seat mattress 20 up and pulling it forwardly by hand, under the work of the pull force and the gravity of the seat back 30, the guiding bar 422 slides upwardly to the top end of the sliding groove 121, until that the seat back 30 and the seat mattress 20 form a 180° angle, and are in the unfolded bed position.

Figure 6:
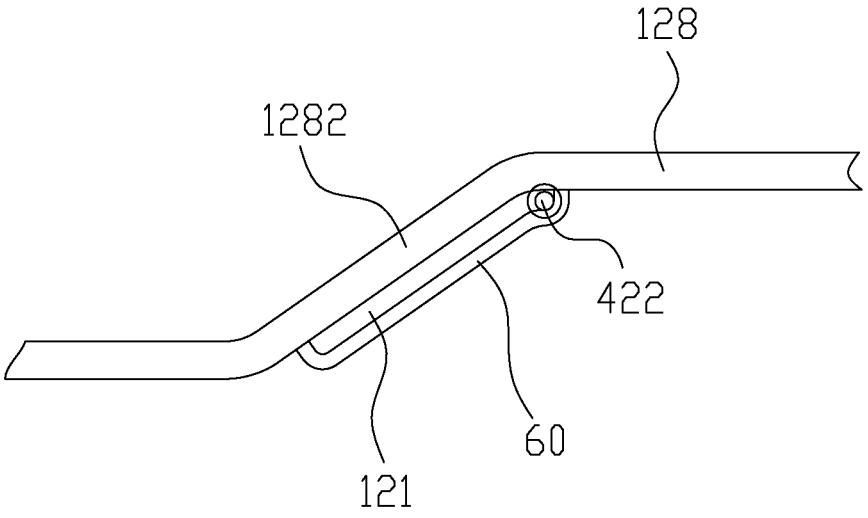
FIG. 6 illustrates a schematic diagram of a guiding bar and a sliding groove of the folding sofa bed in another embodiment.

Referring to FIG. 6, the side of the inclined section 1282 of the guiding rail 128 is connected with a link bar 60, the link bar 60 and the inclined section 1282 surround to be the sliding groove for the guiding bar 422 to slide inside.

A lock mechanism can be further disposed in the armrest border 12 at the lower end position of the sliding groove 121 to lock the guiding bar 422.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

What is claimed is:

1. A folding sofa bed, comprising:

a bed frame comprising: two armrest borders, a seat mattress, a seat back, and a front horizontal bar and a rear horizontal bar connecting the two armrest borders, a central portion of the armrest border disposed with a backwardly disposed and downwardly inclined sliding groove having an upper end and a lower end, two hinges and two connecting bars, each of the hinges comprising a front hinge plate and a rear hinge plate, the front hinge plate connected to the seat mattress, the rear hinge plate connected to the seat back, the front hinge plate disposed with a guide bar, the guide bar slidably disposed inside the sliding groove, the two ends of the connecting bar being respectively hinged to the armrest border and the seat back, the connecting bar supporting the seat back forwardly and inclined upwardly, the seat back and the seat mattress changeable between an unfolded bed position and a folded sofa position; wherein:

in the unfolded bed position, the guiding bar is situated at the upper end of the sliding groove, the seat mattress is horizontally supported by the front horizontal bar, the seat back is horizontally supported by the rear horizontal bar; and in the folded seat position, the guiding bar drops to the lower end of the sliding groove, the seat mattress is inclined and supported by the front horizontal bar, the seat back is inclined and supported by the connecting bars.

2. The folding sofa bed according to claim 1, wherein a bottom portion of the seat mattress is disposed with a lock block, the lock block abuts against the front horizontal bar when in the unfolded bed position.

3. The folding sofa bed according claim 2, wherein each of the armrest borders comprises a front leg, a rear leg and a guiding rail connecting the front leg and the rear leg, the sliding groove is disposed in the guiding rail.

4. The folding sofa bed according to claim 3, wherein the guiding rail comprises an inclined section, an upper straight section connected to a front end of the inclined section and a lower straight section connected to a rear end of the inclined section, the sliding groove is disposed in the inclined section, an end portion of the connecting bar is hinged to the lower straight section.

5. The folding sofa bed according to claim 3, wherein the armrest border further comprises an armrest bar, the armrest bar connecting the top end of the front leg and the top end of the rear leg.

6. The folding sofa bed according to claim 1, wherein a lock mechanism to lock the guiding bar is disposed at the lower end position of the sliding groove.

7. The folding sofa bed according claim 6, wherein each of the armrest borders comprises a front leg, a rear leg and a guiding rail connecting the front leg and the rear leg, the sliding groove is disposed in the guiding rail.

8. The folding sofa bed according to claim 7, wherein the guiding rail comprises an inclined section, an upper straight section connected to a front end of the inclined section and a lower straight section connected to a rear end of the inclined section, the sliding groove is disposed in the inclined section, an end portion of the connecting bar is hinged to the lower straight section.

9. The folding sofa bed according to claim 7, wherein the armrest border further comprises an armrest bar, the armrest bar connecting the top end of the front leg and the top end of the rear leg.

10. The folding sofa bed according to claim 1, wherein each of the armrest borders comprises a front leg, a rear leg and a guiding rail connecting the front leg and the rear leg, the sliding groove is disposed in the guiding rail.

11. The folding sofa bed according to claim 10, wherein the guiding rail comprises an inclined section, an upper straight section connected to a front end of the inclined section and a lower straight section connected to a rear end of the inclined section, the sliding groove is disposed in the inclined section, an end portion of the connecting bar is hinged to the lower straight section.

12. The folding sofa bed according to claim 10, wherein the armrest border further comprises an armrest bar, the armrest bar connecting the top end of the front leg and the top end of the rear leg.

13. The folding sofa bed according to claim 1, wherein the armrest border comprises a front leg, a rear leg and a guiding rail connecting the front leg and the rear leg, the guiding rail comprising an inclined section, an upper straight section connected to a front end of the inclined section and a lower straight section connected to a rear end of the inclined section, the sliding groove is disposed in the inclined section;

wherein one end of the connecting bar is hinged to the end portion of the lower straight section, the other end is hinged to the seat back; wherein the front hinge plate is connected to the seat mattress, the rear hinge plate is connected to the edge of the seat back; wherein the front hinge plate is disposed with the guiding rail, the guiding rail is slidably connected in the sliding groove; and wherein the connecting bar, the seat back, the seat mattress, the hinge and the guiding rail form a linkage mechanism.

14. The folding sofa bed according to claim 13, wherein the upper end of the sliding groove is disposed with a position portion.

15. The folding sofa bed according to claim 13, wherein a cross-section of the sliding groove, and the front end of the corresponding guiding rail are T shaped.

* * * * *